United States Patent [19]

Ohe et al.

[11] Patent Number: 4,941,818

[45] Date of Patent: Jul. 17, 1990

[54] CIGARETTE LIGHTER

[75] Inventors: Kazuhide Ohe, Kamagaya; Kazuo Sato, Ichikawa; Shunpei Fukuda; Hiroyuki Nakada, both of Tokyo, all of Japan

[73] Assignee: TDK Corporation, Tokyo, Japan

[21] Appl. No.: 273,466

[22] Filed: Nov. 18, 1988

[30] Foreign Application Priority Data

Nov. 21, 1987 [JP] Japan ..... 62-177891
Feb. 4, 1988 [JP] Japan ..... 63-14249

[51] Int. Cl.[5] ..... F23Q 11/00
[52] U.S. Cl. ..... 431/268; 131/329
[58] Field of Search ..... 131/329; 431/268

[56] References Cited

U.S. PATENT DOCUMENTS 2,023,400 12/1935 Andrews et al. ..... 131/329 X
2,088,985 8/1937 Widegren ..... 131/329 X
2,243,924 12/1938 Schmitt et al. ..... 131/329 X
2,487,754 11/1949 Cohn .
2,921,176 1/1960 Scofield ..... 431/268
4,207,055 6/1980 Tanaka ..... 431/268
4,235,588 11/1980 Tanaka ..... 431/268

FOREIGN PATENT DOCUMENTS 1560015 2/1969 France .

*Primary Examiner*—V. Millin
*Assistant Examiner*—J. L. Doyle
*Attorney, Agent, or Firm*—Wyatt, Gerber, Burke and Badie

[57] ABSTRACT

The cigarette lighter of the invention has an igniter member which promotes smooth burning of the fuel gas ejected from the gas nozzle. The igniter member is composed of an igniting element which is a coiled wire of platinum metal or a platinum-based alloy having a specified dimensions and a supporting member made of a wire of a refractory metal or alloy. The coil of platinum wire preferably has a flattened configuration to cover a larger front of the flame. The supporting member made of a wire of a refractory metal or alloy, around which the coil is wound, is preferably coated with a coating layer of a ceramic material, e.g., alumina. A simple but very reliable structure for mounting the igniter member in the fire bowl of the cigarette lighter is described.

12 Claims, 16 Drawing Sheets

CIGARETTE LIGHTER

BACKGROUND OF THE INVENTION

The present invention relates to an improved cigarette lighter. More particularly, the invention relates to a cigarette lighter utilizing a catalytic effect of a wire of platinum or a platinum-based alloy as an igniter member for promoting combustion of the inflammable gas of a liquefied fuel ejected out of the nozzle.

It is known to provide a cigarette lighter with an igniter member or combustion-promoting member made of a heat-resistant material at the nozzle from which a fuel gas is ejected so that burning of the fuel gas can be smoothly continued. A conventional igniter member is made from a ceramic material such as alumina shaped in a honeycomb structure to have a large surface area on which a certain catalytic material is deposited. It is also known that such an igniter member is made from a platinum wire.

The above mentioned ceramic-made honeycomb-shaped igniter member is not always suitable for use in a cigarette lighter from the standpoint of practical application. For example, such a ceramic-made igniter member is unavoidably voluminous and hence has a large heat capacity so that it can be red-heated only by taking a length of time and may be subject to localized heating in the portion in direct contact with the flame. These problems can of course be solved by decreasing the wall thickness of the honeycomb structure though producing other problems that the igniter member is liable to be mechanically broken so that the assemblage works of the lighters must be conducted with utmost care and also the member is subject to falling of the surface layer by the repetition of thermal and mechanical shocks caused by lighting on and off. Moreover, manufacturing process of such ceramic-made igniter members requires special apparatuses for shaping, cutting and so on and a great deal of labor to cause an increase in the manufacturing costs.

Conventional igniter members having a platinum wire hitherto used have a problem that the platinum-made igniting element has a relatively small surface area and small heat capacity so that, once the flame is blown off by wind, the temperature of the platinum-made igniting element is rapidly decreased and the platinum wire can no longer exhibit the catalytic activity for the combustion of the fuel gas necessitating another igniting operation by means of the piezoelectric igniting device and the like.

SUMMARY OF THE INVENTION

The present invention accordingly has an object to provide a novel cigarette lighter free from the above mentioned problems and disadvantages in the prior art products in connection with the igniter member mounted at the gas nozzle.

Thus, the cigarette lighter of the present invention comprises an igniting element which is a coil of a wire of platinum metal or a platinum-based material having a diameter of the wire in the range from 0.10 mm to 0.25 mm, of which the pitch of the coil does not exceed 1 mm, mounted at or in the vicinity of a nozzle from which a fuel gas is ejected.

The present invention also provides a novel means for supporting the platinum wire-made igniting element by using a wire member of a refractory metal on which a ceramic layer is formed.

The invention further provides a novel structure for mounting the above mentioned platinum wire-made igniting element supported by a ceramic-coated wire member of a refractory metal at the fuel gas nozzle of a cigarette lighter.

DETAILED DESCRIPTION OF THE PREFERRED EMBODIMENTS

Figure 1:
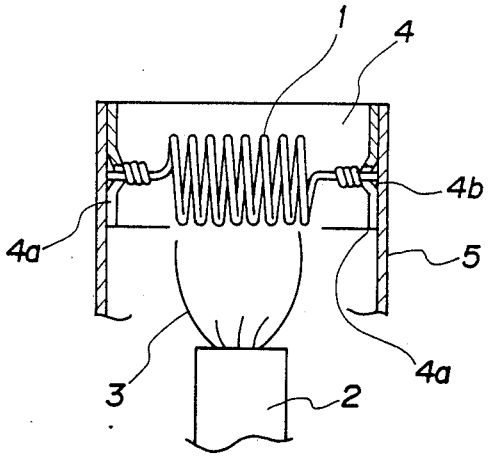
FIG. 1 is a cross sectional side view showing the coiled igniting element mounted in the vicinity of a fuel gas nozzle and FIG. 2 is a bottom view of the same with partial cutting off.
Figure 2:
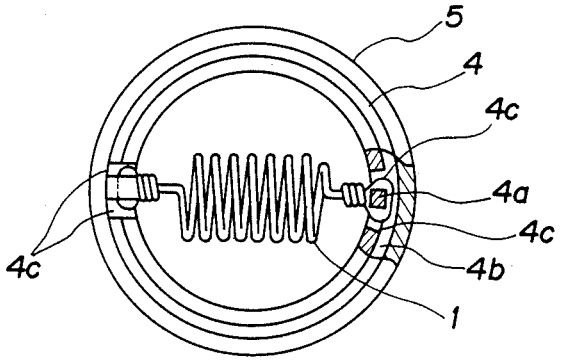
Figure 3:
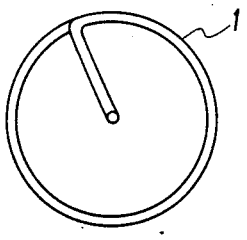
FIG. 3 is the coil of a platinum wire as viewed in the axial direction and FIG. 4 is a partial side view of the same.

In FIGS. 1 to 3, the coil 1 to serve as an igniting element is made of a wire of platinum metal or a platinum-based alloy such as alloys of platinum and iridium, platinum and rhodium and the like optionally containing fine particles of zirconia dispersed therein for reinforcement. The coil 1 is mounted at or in the vicinity of a nozzle 2 from which a fuel gas mixed with air is ejected to form a flame 3 with which the coil 1 is contacted. In this embodiment, the coil 1 is supported at both ends in such a manner that the end portion of the platinum wire is wound around a supporting piece 4*a* provided on the ring member 4. The ring member 4 fits inside of the outer cylindrical member 5. The ring member 4 is provided with a constriction 4*b* in the form of a groove therearound which prevents the coil 1 from coming out of the ring member 4. The supporting piece 4*a* is formed between two notches 4*c* formed at the bottom edge of the ring member 4. Alternatively, the coil 1 can be jointed to the ring member 4 either by welding or by brazing.

Figure 4:
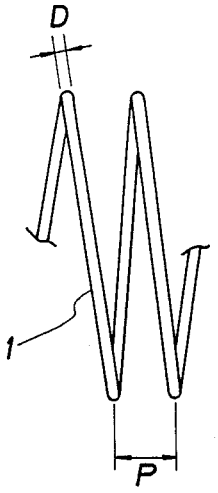

As is illustrated in FIG. 4, the wire to form the coil 1 should preferably have a diameter D in the range from about 0.1 mm to about 0.25 mm. When the diameter D of the wire is too small, the coil made therefrom has a poor mechanical strength. When the diameter of the wire is too large, on the other hand, the coil 1 may have an unduly large heat capacity so that the coil 1 cannot be heated up rapidly when the fuel gas is set on fire by ignition with a piezoelectric or other igniting device so that a delay is caused until the temperature, at which the catalytic activity of the coil 1 is exhibited, can be reached if not to mention the increased costs for the expensive material of platinum or a platinum-based alloy. The winding pitch P of the coil 1 should not exceed 1 mm. When the pitch P is larger than 1 mm, the number of turns of the coil 1 is decreased and the coil 1 cannot have a sufficiently large surface area to exhibit the catalytic promoting effect for combustion of the fuel gas by contacting therewith.

When the coil 1 as an igniting element is installed in the vicinity of the fuel gas nozzle 2 and the fuel gas ejected from the nozzle 2 is ignited by a piezoelectric or other igniting device (not shown in the figures), burning of the fuel gas can be smoothly maintained without unduly increasing the temperature of the flame 3. When the flame 3 has been blown off by wind, the coil 1 is still maintained at a sufficiently high temperature to ensure re-ignition of the fuel gas with the catalytic activity thereof owing to its adequately large heat capacity so that smooth burning of the fuel gas can be re-started by shielding the wind even without operating the igniting device again. Therefore, the cigarette lighter of the invention is used quite satisfactorily even in outdoors under strong wind. In contrast to conventional igniter members made of a ceramic material having brittleness unavoidably necessitating an increase in the thickness and consequently an undue increase of the heat capacity, the coil 1 made of a wire of platinum or a platinum-based alloy may have an adequately large heat capacity only when the dimensions of the coil 1 satisfy the above mentioned requirements in the diameter D of the wire and the winding pitch P of the coil (see FIG. 4). Needless to say, coils of a metal are safer than ceramic-made igniter members against repetition of thermal and mechanical shocks caused by the repeated on-off operations of the igniting device.

It is also a great economical advantage that, in contrast to conventional ceramic-made igniter members manufactured by using special shaping and cutting apparatuses, the igniting element according to the invention can be manufactured very efficiently merely by winding a platinum wire into a coil 1 and mounting the coil 1 on the ring member 4. The igniter member can be mounted on a cigarette lighter without necessitating particular care due to the absence of the danger of fracture thereof.

Figure 5:
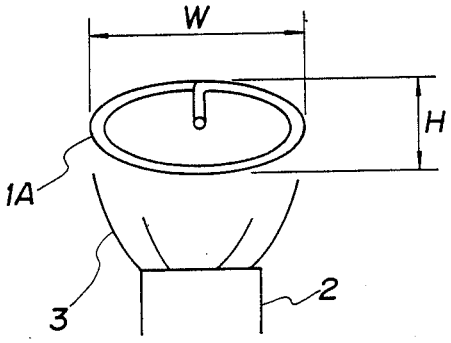
FIG. 5 illustrates an axial view of another igniting element according to the invention in the form of a flattened coil.

FIG. 5 illustrates another embodiment of the invention, in which the cross section of the coil 1A as viewed in the axial direction is not circular but elliptical with its major axis of W facing the nozzle 2 and its minor axis of H in parallel to the burning-up direction of the flame 3. Such a flattened coil 1A is advantageous over the cylindrical coil 1 illustrated in FIGS. 1 to 3 because, assuming an equal weight of the platinum wire used for making the coils 1 and 1A, the flattened coil 1A can cover a wider front of the burning flame 3 than the cylindrical coil 1 within the narrow fire bowl surrounded by the outer cyclindrical member 5.

Figure 6:
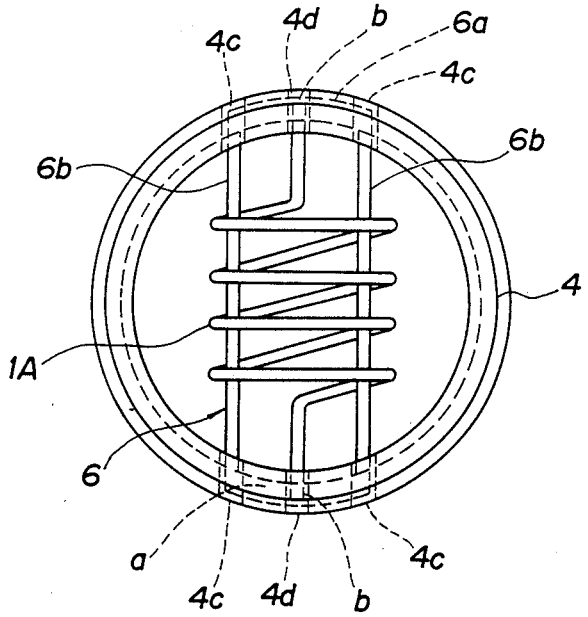
FIGS. 6 and 7 are a plan view and a side view, respectively, illustrating a framed igniter member shown in FIG. 8 mounted on a ring member.
Figure 7:
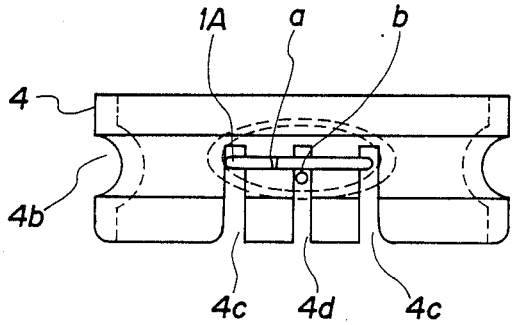
Figure 8:
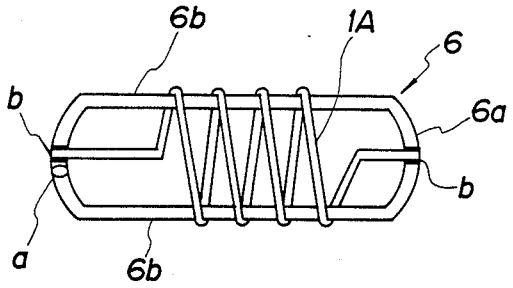
Figure 9:
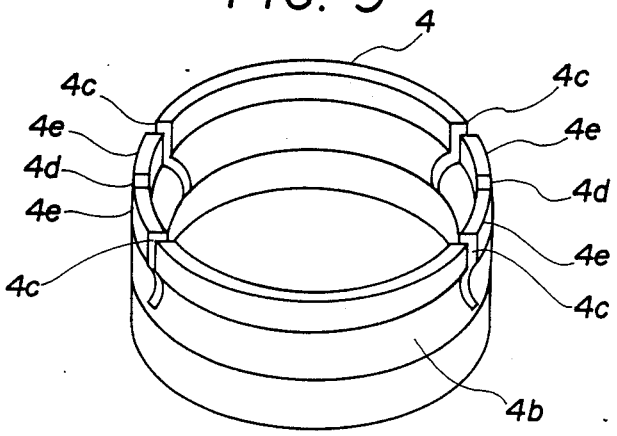
FIG. 9 is a perspective view of a notched ring member and FIG. 10 is a cross sectional side view illustrating the mounting procedure of the igniter member on the notched ring member.

FIGS. 6 to 8 illustrate a further embodiment of the invention in which the flattened coil 1A as the igniting element is supported by the ring member 4 not only at both end portions but also at the body of the coil 1A by two supporting members 6*b*,6*b* each made of a refractory metallic material which may be Nichrome, Kanthal and the like. Though not limitative thereto, the supporting members 6*b*,6*b* can be formed of a single wire 6 which is bent in an approximately rectangular frame-like form composed of a bent portion 6*a* and two parallel leg portions 6*b*,6*b*, the end portions thereof being bent and jointed together at the point a by welding, brazing, wire twisting or other convenient means. The leg portions 6*b*,6*b* each penetrate the coil 1A in contact therewith or a platinum wire is loosely wound around the leg portions 6*b*,6*b* of the thus formed frame-like supporting member 6. The end portions of the coil 1A can be jointed to the supporting member 6 by welding, brazing or wire twisting to form an igniter member composed of the coil 1A as the igniting element supported by the frame-like supporting member 6. The ring member 4 having a groove-like constriction 4*b* around is provided with a set of three notches 4*c*,4*d*,4*c* from the bottom surface to reach the upper portion of the constriction 4*b* at each of the two radially opposite positions as is shown in FIG. 9. The igniter member composed of the coil 1A and the supporting frame 6 is mounted on the ring member 4 in such a manner that each of the parallel leg portions 6*b*,6*b* rests at the end portions thereof on the notches 4*c* and 4*c* in the opposite sets of notches while the end portions of the coil 1A rest on the opposite notches 4*d* and 4*d*.

Figure 10:
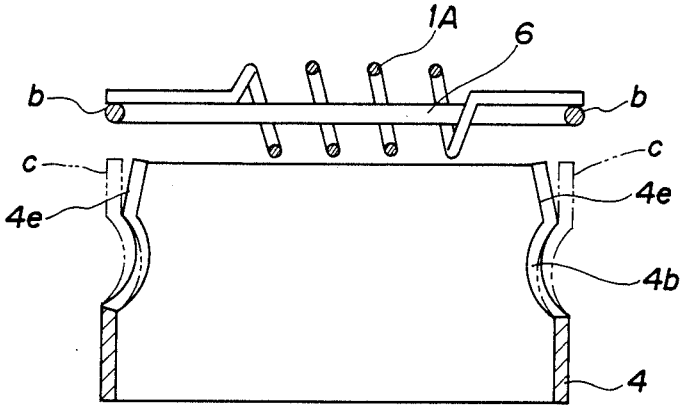

A convenient actual process of assembling the igniter member illustrated in FIG. 8 and the ring member 4 illustrated in FIG. 9 is as follows. Thus, the coil 1A is first welded to the frame 6 at the points a and b as is shown in FIG. 8 to form a framed igniter member. The four flaps 4*e* formed by providing notches 4*c*,4*d*,4*c* at each of the two radially opposite positions of the ring member 4 (see FIG. 9) are each slightly bent inwardly beforehand as is shown by the solid lines in FIG. 10 and, after mounting the framed igniter member on the notches of the ring member 4 as is mentioned above, each of the flaps 4*e* is returned to its original unbent position as is shown by the two-dots chain lines c in FIG. 10.

It is important that the coil 1A is made by winding a platinum wire around the frame 6 loosely or not too tightly so that the contacting area between the coil 1A and the frame 6 is minimized and the heat loss from the coil 1A to the frame 6 and to the ring member 4 by heat conduction is minimized. By this means, the rate of temperature decrease in the coil 1A when the flame 3 becomes blown off is decreased so as to ensure a good performance of re-ignition even when the coil 1A is made by using a relatively fine platinum wire.

As is understood from the above given description, the use of a supporting frame member 6 is advantageous in respect of the possibility of cost saving for the platinum coil because the coil may have a reliable support of the frame 6 even when it is made of a relatively fine platinum wire otherwise to cause unreliableness of the coil configuration. The wire of the refractory metal for forming the frame 6 has a diameter preferably in the range from 0.1 mm to 0.4 mm. When the diameter is too large, the frame member 6 may conduct a large quantity of heat from the coil to the ring member 4 which is then heated at a high rate to cause some inconvenience in handling the cigarette lighter. The supporting frame member 6 made of a refractory metal wire having a diameter smaller than 0.1 mm is of course undesirable due to the poor mechanical strength.

Figure 11:
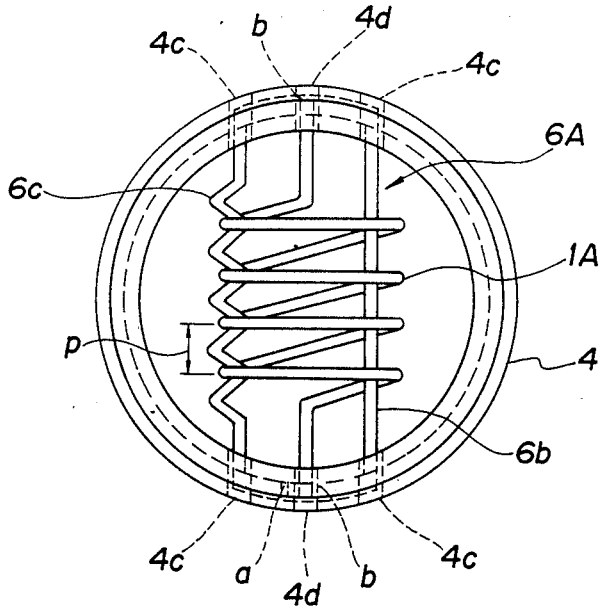
FIGS. 11 and 12 illustrate a further embodiment of the igniter member according to the invention by a plan view and a side view, respectively.
Figure 12:
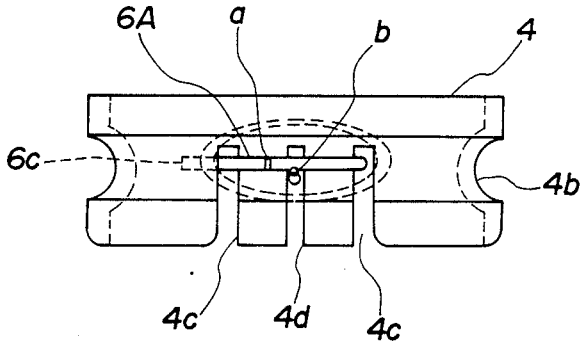

FIGS. 11 and 12 illustrate another embodiment which is a modification of the embodiment illustrated in FIGS. 6 to 8. As is shown in FIG. 11, one of the leg portions 6c of the frame member 6A is shaped in a zigzag form and the coil 1A is formed by winding a platinum wire around the frame member 6A in such a manner that each turn of the coil 1A :s received by one of the nicked corners of the zigzag-formed leg portion 6c of the frame member 6A. In this manner, advantages are obtained that the platinum wire can be wound around the frame member 6A easily at a definite pitch P to form the coil 1A which can be freed from deformation to cause a change in the pitch P of the coil during use of the cigarette lighter of the invention.

Figure 13:
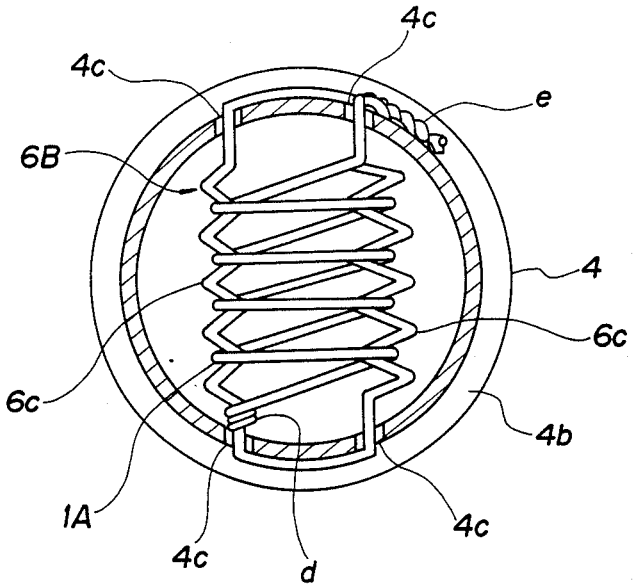
FIG. 13 is a plan view illustrating an igniter member which is a modification of that shown in FIGS. 11 and 12.

FIG. 13 illustrates a further development of the model illustrated in FIGS. 11 and 12, in which both of the leg portions 6c,6c of the frame member 6B are shaped each in a zigzag form so that the advantages obtained in the embodiment of FIGS. 11 and 12 can be enlarged to further improve the productivity in manufacture and the shape-retainability of the coil 1A during use. Note that, in the model illustrated in FIG. 13, the coil 1A is jointed to the frame member 6B by winding at the point d and by wire twisting at the point e where the end portions of the refractory metal wire 6 are twisted together to form the frame member 6B. Accordingly, the ring member 4 is provided with two sets of notches each set being composed of two notches 4c,4c alone, one of which receives a leg portion 6c of the frame member 6B and the other of which receives jointly another leg portion 6c of the frame member 6B and one of the end portions of the coil 1A.

Figure 14A:
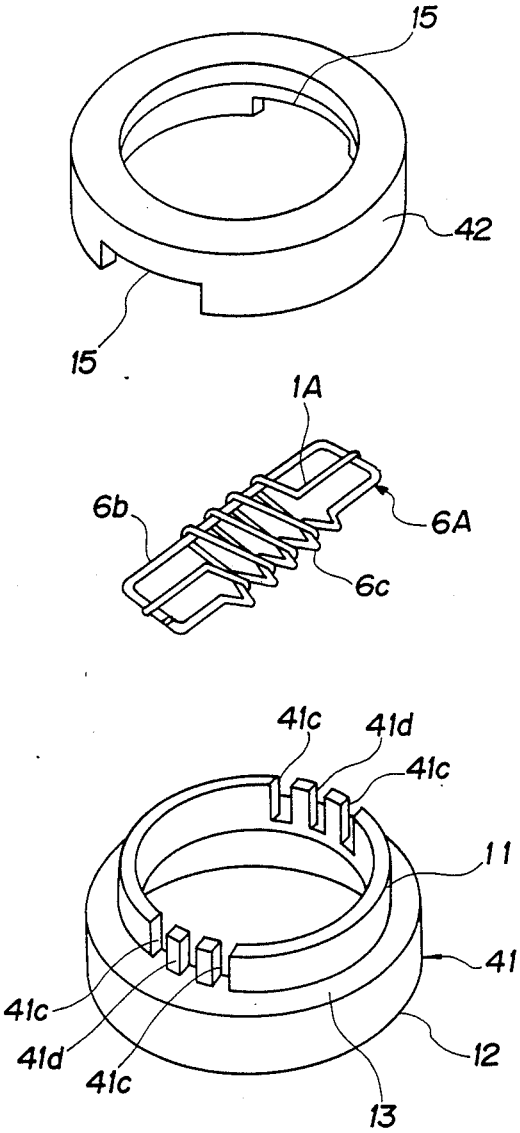
FIG. 14*a* is a perspective view of a disassembled assembly of the igniter member and a ring member divided into an upper ring piece and a lower ring piece and FIG. 14*b* is a plan view of the assembly.

Following is an example of the actual design by which the igniter member is mounted in the vicinity of the fuel gas nozzle of a cigarette lighter by means of a ring member. FIG. 14a is a perspective view of the igniter member and the ring member, on which the igniter member is mounted, disassembled into two parts. Namely, the ring member is divided into two parts of a lower ring piece 41 and an upper ring piece 42. The lower half portion 12 of the lower ring piece 41 has an outer diameter larger than that of the upper half portion 11 and the upper half portion 11 having a smaller diameter is provided with two sets of notches at the radially opposite positions each set having three notches 41c,41d,41c. The upper ring piece 42 is provided with two broad notches 15,15 at radially opposite positions. The inner diameter of the upper ring piece 42 at the height of the notches 15,15 is so large as to just fit the outer diameter of the upper half portion 11 of the lower ring piece 41 so that the upper ring piece 42 can be mounted on the lower ring piece 41 just to fit each other with its lower end resting on the annular surface 13 between the upper and lower half portions 11 and 12 of the lower ring piece 41.

Figure 14B:
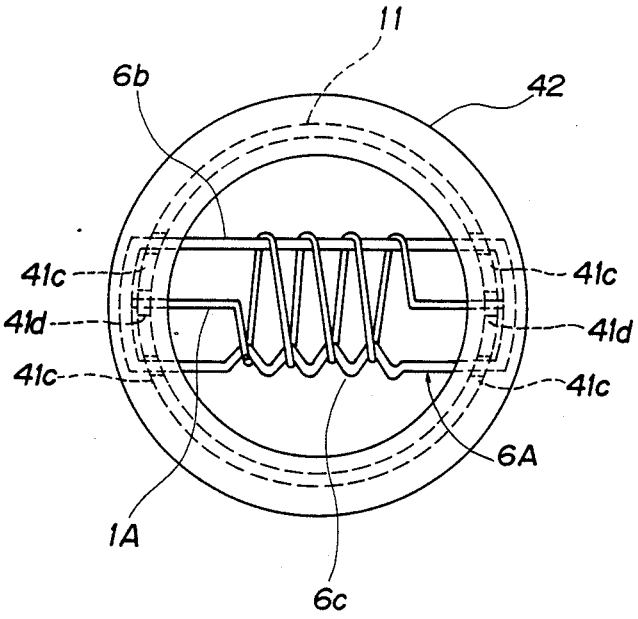

In assembling these parts, the igniter member is put on the lower ring piece 41 in such a manner that the end portions of the leg portions 6b,6c of the supporting member 6A each rest in one of the four notches 41c and the end portions of the platinum wire forming the coil 1A each rest in one of the center notches 41d. Then, the upper ring piece 42 is mounted on the lower ring piece 41 as a cap ring in such a radial direction that each of the broad notches 15 falls outside the set of notches 41c,41d,41c in the lower ring piece 41 and that the bottom surface of the broad notch 15 presses down the end portion of the igniter assembly coming out of the set of notches 41c,41d,41c. In this manner, the igniter member can be tightly fixed at the position between the lower and upper ring pieces 41 and 42. FIG. 14b illustrates a plan view of such an assembly. When the igniter member is mounted on the ring member in the above described manner, it is not always necessary that the end portions of the platinum wire forming the coil 1A are bonded to the frame like supporting member 6A by welding or brazing thus to be completely freed from the troubles due to eventual disconnection of the platinum coil 1A from the supporting member 6A by the thermal and mechanical shocks or at an overly high temperature to melt down the brazing alloy accidentally encountered during use. Needless to say, the igniter member need not be bonded to the ring member by welding, brazing or other troublesome means greatly contributing to cost reduction in the works of assemblage.

Figure 15:
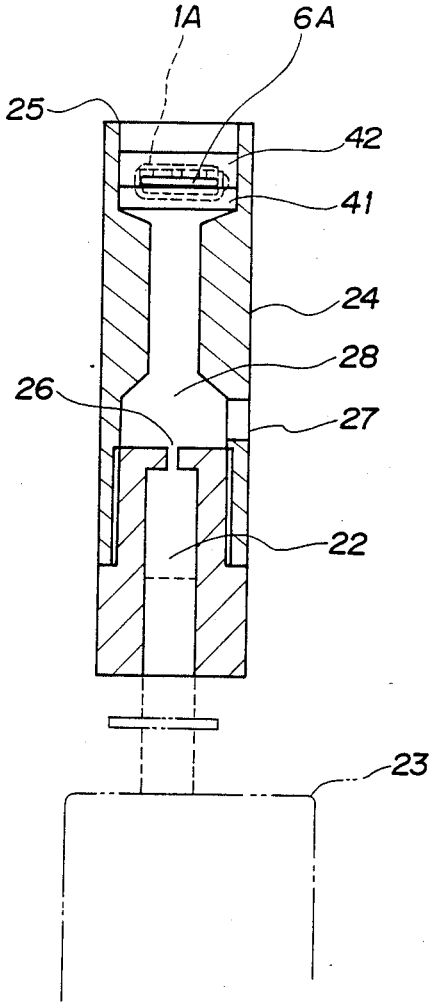
FIG. 15 is a schematic cross sectional view of the combustor portion of a cigarette lighter having an igniter member built therein.

FIG. 15 is a schematic cross sectional view of the combustor portion of a cigarette lighter with the above described igniter member built therein. The lower and upper ring pieces 41, 42 holding the igniter member formed of the coil 1A and the supporting member 6A is mounted on the fire bowl 25 at the end of the tubular body 24 of a cigarette lighter by fitting thereto. The tubular body 24 is provided with an air-intake opening 27. The fuel gas produced by the vaporization of the liquid fuel in the fuel reservoir 23 is ejected from the nozzle throat 26 at the end of the nozzle 22 entraining air from the air-intake opening 27 and mixed together therewith in the mixing chamber 28. When an igniting device, for example, utilizing a piezoelectric element (not shown in the figure) of the lighter is operated, the fuel gas admixed with air is ignited in the fire bowl 25 so that the igniting element 1A of the igniter member is heated by the flame to exhibit the catalytic activity thereby to ensure smooth combustion of the fuel gas.

Figure 16A:
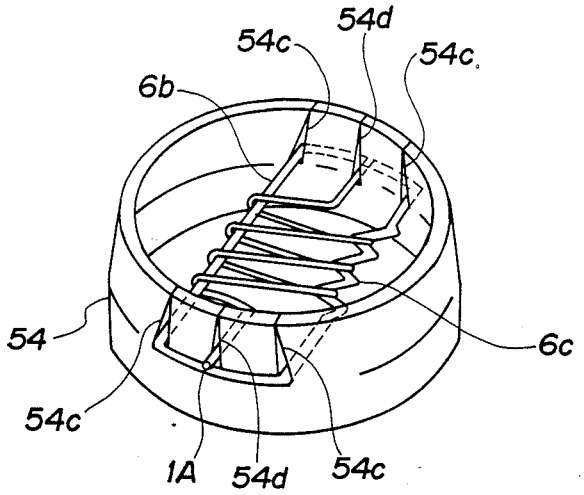
FIGS. 16*a* and 16*b* illustrate a ring member holding the igniter member by caulking by a perspective view and a plan view, respectively.
Figure 16B:
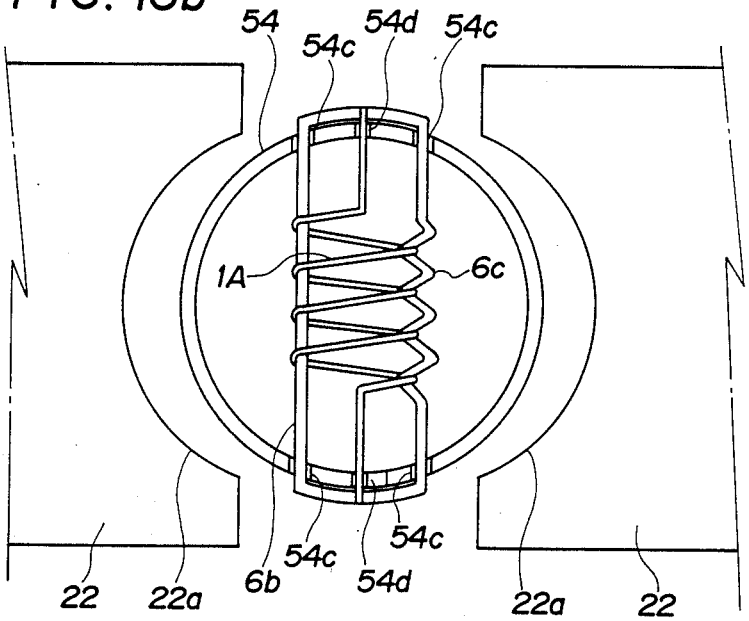

FIGS. 16a and 16b illustrate another modification in the manner for mounting the igniter member on the ring member. FIG. 16a is a perspective view of the ring member 54 on which an igniter member is mounted. The upper portion of the ring member 54 has a tapered or truncated cone like configuration and is provided with two sets of notches each composed of three notches 54c,54d,54c at the radially opposite positions. When the igniter member is mounted on the ring 54 to be received by the respective notches as is illustrated in FIG. 16b, the upper portion of the ring member 54 including the flaps 54e is caulked by means of a pair of pressing members 22 each having an arc-wise curved pressing edge 22a so that the igniter member is fixed in the notches by the deformation of the ring member 54 as is illustrated in FIG. 16a.

Figure 17A:
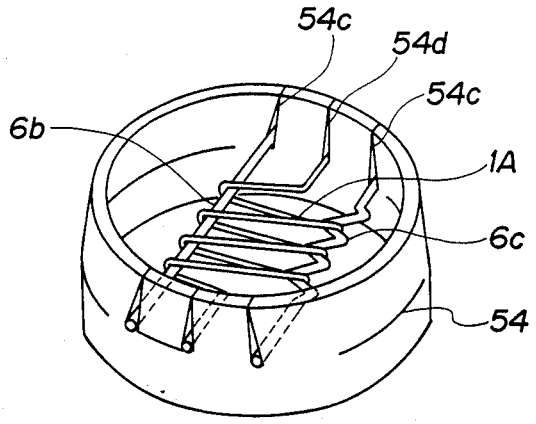
FIGS. 17*a* and 17*b* illustrate the same ring member as in FIG. 16*a*, the supporting member mounted on which is not in the form of a frame but composed of two separate leg members.
Figure 17B:
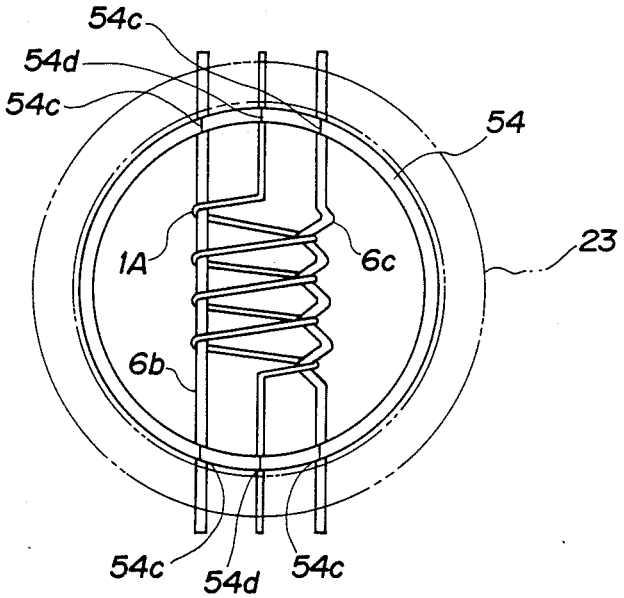

FIGS. 17a and 17b illustrate a modification of the embodiment of FIGS. 16a and 16b relative to the mounting of the igniter member on the ring member. In this embodiment, the supporting member is not in the frame-like form but composed of two separate leg members 6b and 6c. The end portions of the coil 1A are not jointed to these leg members 6b,6c but are extended straightly as is shown in FIG. 17b. When the igniter member is mounted on the notches 54c,54d,54c, accordingly, the end portions of the leg members 6b,6c of the supporting member and the coil 1A are each protruded out of the notches 54c or 54d of the ring member. Thereafter, these protruded end portions are cut off by means of a circular cutter 23 having a diameter somewhat larger than the outer diameter of the ring member 54.

Figure 18:
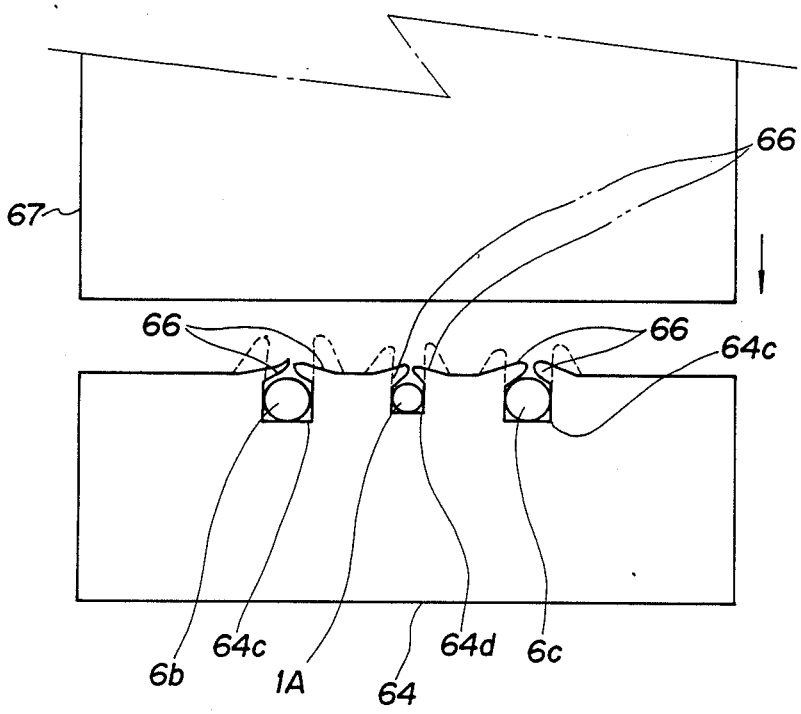
FIG. 18 is a schematic side view of a ring member having notches with rising nibs to receive and fix the end portions of the coil and supporting member.

FIG. 18 illustrates another modification of the ring member illustrated in FIG. 17a. In the ring member 64, the side portions of each notches 64c,64d are shaped in the form of a rising nib 66 shown by the broken line. After the end portions of the coil 1A and supporting members 6b,6c are received in the respective notches, the rising nibs 66 are each deformed downwardly by means of the pressing tool 67 as is shown by the solid line to hold down the end portions of the coil 1A and the supporting members 6b,6c resting in the respective notches 64d,64c.

The above described manners by which the coil 1 or 1A is supported by a supporting member are of course only to show several examples of possible modifications. Further, it is advantageous that the supporting member formed of a wire of a refractory metal or alloy is provided with a surface coating layer of a ceramic material to protect the wire of the refractory metal or alloy against oxidation.

Figure 19:
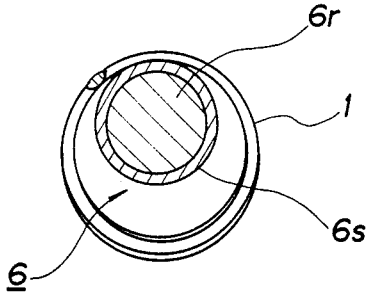
FIG. 19 is a cross sectional view of a ceramic-coated supporting member around which a coil of a platinum wire is wound.

FIG. 19 illustrates a cross sectional view of the ceramic-coated supporting member 6 formed of a core wire 6r of a refractory metal or alloy and a coating layer 6s of a ceramic material on the surface of the core wire 6r. This supporting member 6 supports a coil 1 of a platinum wire wound therearound in loose contact. The ceramic material forming the coating layer 6s is not particularly limitative. Examples of suitable ceramic materials include silica, alumina, silicon carbide and the like. Such a coating layer 6s of a ceramic material can be formed by any known method. For example, a wire of the refractory metal or alloy 6r is first shaped into a frame-like, lattice-like or other desired structure and then coated with a ceramic-forming coating composition containing a ceramic forming material such as an alkyl silicate, organopolysiloxane, titanopolymer, metal alkoxide, silica sol, phosphate, alkali metal silicate and the like followed by baking to convert the ceramic-forming material into a ceramic. It is known that a titanopolymer-based coating composition with admixture of an inorganic filler of silica, alumina, silicon carbide and the like with an object to improve the hardness and adhesion of the coating layer 6s can produce a ceramic coating layer of which the weight loss by heating is only 10% by weight or less even when it is heated up to 1000° C.

Use of $\gamma$-alumina as the ceramic material for the coating layer 6s is advantageous over $\alpha$-alumina because $\gamma$-alumina can be easily obtained in a porous form and has an activity for promoting combustion of the fuel gas. Such a $\gamma$-alumina based coating layer can be obtained by coating the core wire with a pasty slurry of aluminum hydroxide followed by a heat treatment at a temperature of 500° to 700° C. for a length of time of, for example, 1 hour. It is also a possible way that the core wire made of a Kanthal alloy, which can withstand a temperature of about 1400° C., is subjected to a heat treatment in air at a temperature of, for example, 1080° C. for about 8 hours so that the surface layer of the core wire is oxidized and converted into a ceramic material mainly composed of alumina by the oxidation of the aluminum as an alloying element of the Kanthal alloy. It is of course optional that the coating layer 6s of the ceramic material thus formed further contains a catalytically more active ingredient to promote smooth combustion of the fuel gas. It is also an advantageous way that the surface of the ceramic coating layer has an increased surface area by being imparted with corrugation or irregularity.

Figure 20A:
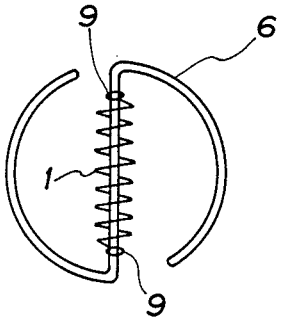
FIG. 20*a* illustrates a plan view of an igniter member having a supporting member shaped in an S-shape and FIG. 20*b* illustrates such an igniter member mounted on a ring member having a bulge around utilizing the resilience of the supporting member.
Figure 20B:
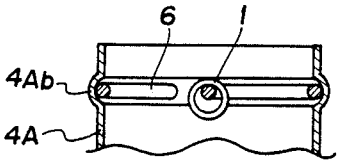

FIGS. 20a and 20b illustrate a simple but reliable means to built an igniter member in a cigarette lighter. As is shown in FIG. 20a, the supporting member 6 formed of a ceramic-coated wire of a refractory metal or alloy is shaped in an S-shaped form, the two end portions jointly making a circular form as a whole, and the coil 1 of a platinum wire is wound only around the straight center portion of the S-shaped supporting member 6. In this case, the igniter member is mounted on and inside of the ring member 4A which has a bulge 4Ab therearound as being received in the groove behind the bulge 4Ab by utilizing the elastic resilience of the S-shaped supporting member 6.

Figure 21A:
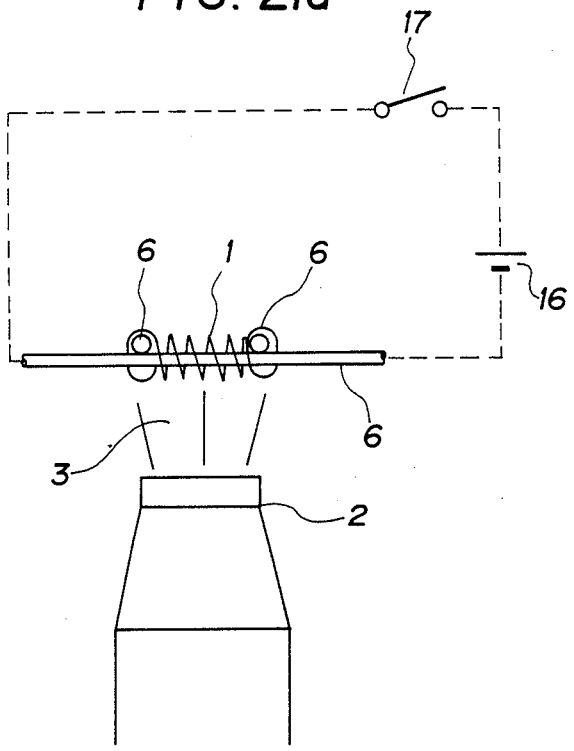
FIGS. 21*a* and 21*b* are a side view and a plan view, respectively, of a platinum coil supported by a supporting member having a latticd structure of four bar members.
Figure 21B:
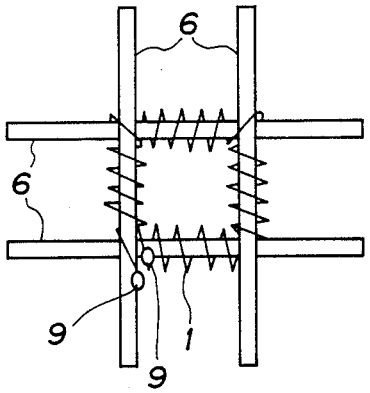

FIGS. 21a and 21b illustrate a platinum coil 1 wound around such a ceramic-coated supporting member 6 forming a lattice-like structure or in a #-form which is a part of an electric circuit including a power source 16, e.g., a dry cell, and a switch 17 interlinked with the valve (not shown in the figures) of the fuel gas nozzle 2. By closing the switch 17 with opening of the valve of the fuel gas nozzle, the ceramic-coated supporting member 6 serves as an electric heater working as an igniting device or further improving the efficiency of the catalytic activity of the platinum coil 1. The end portions of the platinum wire forming the coil 1 may be fixed to the supporting member 6 by a suitable means, for example, utilizing bumps 9,9 of the ceramic material formed from the ceramic-forming coating composition by integrating the end portions of the platinum wire by baking. Although the platinum coil 1 illustrated in FIGS. 21a and 21b are formed by winding a single platinum wire around the four bar members forming the lattice-like supporting member 6, it is optional that each of the four bar members has its coil independently from the coils wound around the other three of the bar members and then the four bar members are assembled to form a lattice-like structure by bonding using the ceramic-forming composition.

In the igniter member as described above built in a pocketable cigarette lighter, the ceramic-coated wire of a refractory metal or alloy forming the supporting member preferably has a diameter in the range from about 0.2 mm to about 0.3 mm. When the diameter is too large, the metal-made parts surrounding the igniter member Would be heated too high as the igniter member is red-heated. The refractory wire having a too small diameter is of course undesirable in respect of the mechanical strength.

Figure 22A:
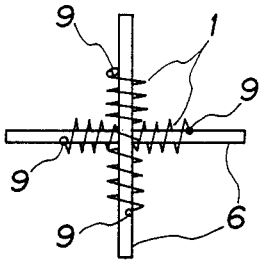
FIGS. 22*a*, 22*b* and 22*c* each illustrate an igniter member having a supporting member of a cross-like structure formed of two bar members.
Figure 22B:
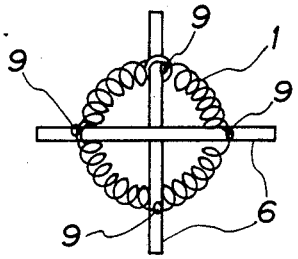
Figure 22C:
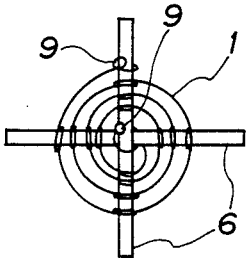

The structure of the supporting member can be varied in a variety of ways according to desire besides the above described frame-like and lattice-like ones. FIGS. 22*a*, 22*b* and 22*c* each illustrate a different type of the igniter member composed of a structure of the supporting member and one or more of platinum-made coils supported thereby. In FIGS. 22*a*, 22*b* and 22*c*, the supporting member has a crosslike structure 6 as formed of two intersecting bar members. In FIG. 22*a*, each of the bar members has a platinum-made coil 1 wound therearound and fixed thereto at the end portions of the platinum wire by means of ceramic bumps 9. In FIG. 22*b*, each of the bar members of the cross-like supporting member 6 has no platinum-made coil wound therearound but four platinum-made coils 1 are each fixed at the ends thereof to the bar members by means of ceramic bumps 9 so as to form a ring-like sequence of the four coils 1 surrounding the center of the cross. In FIG. 22*c*, the platinum wire-made igniting element 1 is not in the form of a coil but in the form of a spiral starting from the center of the cross-like structure of the supporting member 6, the ends of the platinum wire being fixed, one, to the center of the cross and, the other, to one of the bar members at a distance from the center by utilizing ceramic bumps 9.

Figure 23A:
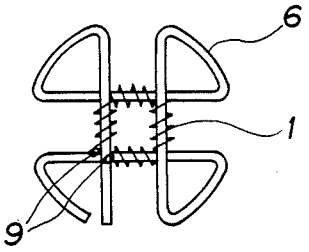
FIGS. 23*a*, 23*b* and 23*c* each illustrate an igniter member having a supporting member of a lattice-like structure which is a wirework formed of a single ceramic-coated wire of a refractory metal or alloy.
Figure 23B:
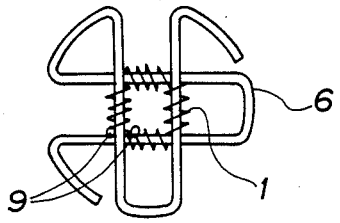
Figure 23C:
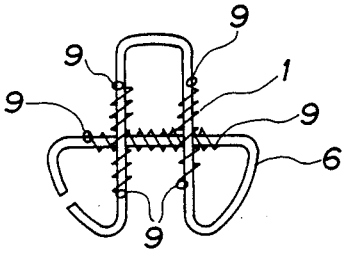

FIGS. 23*a*, 23*b* and 23*c* each illustrate a modification of the igniter member composed of one or more of platinum-made coils 1 and a supporting member 6 having a lattice-like wirework structure formed from a single ceramic coated wire of a refractory metal or alloy to which the platinum coils 1 are bonded by means of ceramic bumps 9.

It should be understood that the application field of the above described igniter member is not limited to cigarette lighters but also to all kinds of gas-burning instruments including gas burners for cooking, gas heaters, gas burners built in a resin-sheet puncher, warm-keeping box, heater for working with shrinkable tubes and the like, hot-bulb semidiesel engines, alcohol burners and so on.

What is claimed is:

1. A cigarette lighter having a combustor portion ignitable by a fuel gas from a nozzle from which said fuel gas is ejected in a fire bowl of the combustor portion, said cigarette lighter comprising an igniting element made of a wire of platinum metal or a platinum-based material having a diameter of the wire in the range from 0.10 mm to 0.25 mm, of which the pitch of the coil does not exceed 1 mm, said coil being mounted at or near the vicinity of said nozzle from which the fuel gas is ejected in a fire bowl of the combustor portion.

2. The cigarette lighter as claimed in claim 1 wherein the igniting element is supported by a supporting member formed of a wire of a refractory metal or alloy.

3. The cigarette lighter as claimed in claim 2 wherein the wire of the refractory metal or alloy forming the supporting member has a diameter in the range from 0.1 mm to 0.4 mm.

4. The cigarette lighter as claimed in claim 1 wherein the radial cross section of the coil has a flattened or elliptical form having the major axis thereof facing the fuel gas nozzle.

5. The cigarette lighter as claimed in claim 2 wherein the coil is supported by the supporting member by being wound around said supporting member.

6. The cigarette lighter as claimed in claim 2 wherein the coil is supported by two supporting members substantially in parallel with each other by being wound around the supporting members.

7. The cigarette lighter as claimed in claim 6 wherein at least one of the two supporting members has a zigzag form and each turn of the coil is received in one of the nicked corners of the zigzag-formed supporting member.

8. The cigarette lighter as claimed in claim 6 wherein the supporting members have end portions, each of said end portions resting on a notch formed in a ring member surrounding the fire bowl of the combustor.

9. The cigarette lighter as claimed in claim 8 wherein the ring member is divided into a lower ring piece and an upper ring piece, said lower ring piece being provided with the notches to receive the end portions of the supporting members and said upper ring piece, just fits to said lower ring piece so as to hold the end portions of the supporting members therebetween.

10. The cigarette lighter as claimed in claim 2 wherein the wire of a refractory metal or alloy forming the supporting member has a coating layer of a ceramic material.

11. The cigarette lighter as claimed in claim 10 wherein the ceramic material of the coating layer is selected from the group consisting of silica, alumina and silicon carbide.

12. The cigarette lighter as claimed in claim 10 wherein the ceramic material of the coating layer is $\gamma$-alumina.

* * * * *